US006484636B1

(12) United States Patent
Seefried

(10) Patent No.: US 6,484,636 B1
(45) Date of Patent: Nov. 26, 2002

(54) CLEANING DEVICE FOR A PRINTING MACHINE

(75) Inventor: Karl-Heinz Seefried, Zuzenhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/663,572

(22) Filed: Sep. 15, 2000

(30) Foreign Application Priority Data

Sep. 15, 1999 (DE) ..... 199 44 158

(51) Int. Cl.[7] ..... B41F 35/00; B41L 41/00
(52) U.S. Cl. ..... 101/425; 101/423; 101/480
(58) Field of Search ..... 101/480, 423, 101/424, 425

(56) References Cited

U.S. PATENT DOCUMENTS

| | | | | |
|---|---|---|---|---|
| 4,932,322 A | * | 6/1990 | Keller | 101/219 |
| 5,105,740 A | | 4/1992 | Loos et al. | 101/425 |
| 5,769,461 A | | 6/1998 | Hildebrandt et al. | 101/494 |
| 5,943,956 A | * | 8/1999 | Marquez et al. | 101/425 |
| 6,024,019 A | * | 2/2000 | Williams et al. | 101/463.1 |

FOREIGN PATENT DOCUMENTS

| | | |
|---|---|---|
| DE | 39 09 119 A1 | 9/1990 |
| DE | 92 12 882.3 U1 | 1/1993 |
| DE | 42 33 953 A1 | 4/1994 |
| DE | 43 28 834 A1 | 3/1995 |
| DE | 197 37 783 A1 | 7/1998 |
| DE | 195 06 640 C2 | 8/1998 |
| EP | 0 795 401 A1 | 9/1997 |

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

A printing machine has a subassembly couplable therewith and being insertable therein. The subassembly includes a rotor mounted in a mounting which allows, in addition to a rotation of the the rotor about a first axis, a pivoting of the rotor about at least one second axis which is oriented at an angle to the first axis.

20 Claims, 6 Drawing Sheets

CLEANING DEVICE FOR A PRINTING MACHINE

BACKGROUND OF THE INVENTION

Field of the Invention

The invention relates to a printing machine with a subassembly couplable therewith and insertable therein.

A prevailing problem in printing machines is the recoupling of washing bars to a drive assigned to the printing machine after they have been removed temporarily from the printing machine for maintenance purposes. The washing bars are pushed through an aperture into the printing machine transversely to the printing direction. During the process, the pressman stands near the aperture which is formed in the operating side of the printing machine. The pressman has to push the washing bar into the printing machine with great care, because it is not possible for the pressman to monitor the coupling operation visually. The connecting elements for coupling are located on the drive side of the printing machine, the connecting elements being located opposite the aperture and, during coupling, being concealed by the washing bar in the viewing direction of the pressman. Damage to the connecting elements is not ruled out entirely, even when the pressman endeavors to push the connecting elements into engagement with one another very carefully.

The published German Patent Document DE 42 33 953 A1 describes a printing machine corresponding to the generic type mentioned in the introduction hereto. In the described printing machine, the subassembly is formed by a washing bar and a rotor of a dirty-cloth spindle of the washing bar. The dirty-cloth spindle is rotatable about the central axis thereof and is pivotable, together with the washing bar, about a pivot axis oriented parallel to the central axis. A drive for stepwise rotating the dirty-cloth spindle is arranged on a suspension device which is pivotable, together with the washing bar, about the pivot axis. Fastened to the suspension device is a guide body, whereon the washing bar is capable of being moved into the printing machine. The guide body is provided with an arm, to which there is fastened one clutch half of a clutch which serves for coupling the dirty-cloth spindle automatically to the drive when the washing bar is being moved in. The rigid connection of the clutch half to the guide body ensures that, when the washing bar is being pushed in, the other clutch half, which is fastened to the latter, always meets the clutch half, which is fastened to the arm, in an exact position relative to the latter. In the described printing machine, also, coupling therefore presents comparatively few problems, because the two clutch halves are arranged in axial alignment with one another.

For specific reasons, however, it is desirable to adopt a different construction from that described above. In particular, with regard to increasing the stability of the guide body, the latter should not be fastened to the suspension device, but instead, to the printing machine stand. In this possible construction, therefore, the suspension device would be movable relative to the guide body. Although the stability of this construction would be comparatively high, there would be a problem, inherent in the design, that, due to production tolerances, the position of the suspension device relative to the guide body may be slightly different whenever the washing bar is pushed in. The pressman, when pushing the washing bar in, would therefore have to manipulate it with particular care until the clutch halves are suitably aligned with one another without causing damage to one another. For reasons of economic production, too, there is a desire to adopt a different construction from that described in the published patent document, by making it possible to do away with the clutch quite completely, and to enable the coupling of the washing bar to the drive via other connecting elements.

The published European Patent Document EP 0 795 401 A1 describes a subassembly couplable to a printing machine and being in the form of a washing device with a washing brush. Arranged on a machine stand is a first clutch part operatively connected to a second clutch part which is arranged on the movable subassembly. The first clutch part arranged on the machine stand is freely movable and compensates for any possible bearing offset of the second clutch part which is arranged on the subassembly. The two somewhat platelike clutch parts accommodate supply lines for washing medium and water. The device is suitable for the releasable connection of supply lines of this type, but not for connecting a rotor to a drive, and therefore cannot make any contribution to solving the problem outlined hereinabove.

Further prior art is described in the published German Patent Document DE 197 37 783 A1.

SUMMARY OF THE INVENTION

It is accordingly an object of the invention to provide a printing machine with a subassembly couplable to and being insertable into the latter, wherein a guide provided for pushing in the subassembly is can be fastened to the printing-machine stand, and is user-friendly for the pressman, particularly with regard to avoiding damage to connecting elements during coupling.

With the foregoing and other objects in view, there is provided, in accordance with the invention, a printing machine with a subassembly couplable therewith and being insertable therein, the subassembly comprising a rotor mounted in a mounting which allows, in addition to a rotation of the rotor about a first axis, a pivoting of the rotor about at least one second axis which is oriented at an angle to the first axis.

In accordance with another feature of the invention, the at least one second axis is oriented obliquely or at an inclination to the first axis.

In accordance with an alternative feature of the invention, the at least one second axis is oriented perpendicularly to the first axis.

In accordance with a further feature of the invention, the mounting is a pendulum bearing.

In accordance with an added feature of the invention, the printing machine includes a drive external to the subassembly, for rotating the rotor, the subassembly, when being pushed into the printing machine, being couplable with the drive.

In accordance with an additional feature of the invention, the rotor is drivable by the drive via a releasable drive connection including a first connecting element fastened to the subassembly, and a second connecting element external to the subassembly.

In accordance with yet another feature of the invention, the mounting and the first connecting element are disposed at opposite ends of the subassembly.

In accordance with yet a further feature of the invention, the first connecting element is arranged coaxially with the rotor and is connected so as to be fixed against rotation relative to the rotor.

In accordance with yet an added feature of the invention, the second connecting element is fastened to an adjusting part of the printing machine, the adjusting part being movably connected to a stand of the printing machine.

In accordance with yet an additional feature of the invention, the connecting elements are two gear members of the drive connection for rotating the rotor, the gear members being axially offset with respect to one another.

In accordance with still another feature of the invention, the subassembly includes at least one centering device for orienting the adjusting part and the subassembly during insertion of the subassembly into the printing machine.

In accordance with a concomitant feature of the invention, the subassembly is a cleaning device, and the rotor is a cleaning roller of the cleaning device.

Thus, the subassembly of the printing machine according to the invention includes a rotor pivotable about at least one pivot axis which does not extend parallel to the axis of rotation of the rotor. When the subassembly is being pushed into the printing machine, therefore, a pivoting movement of the rotor about the at least one pivot axis compensates for a possible position offset which exists between two connecting elements serving for coupling the subassembly to the printing machine. For example, the mounting of the rotor may be constructed as a cardan joint which connects the axis of rotation and the pivot axis to one another. The mounting may also be a ball joint, for example, if the rotor is rotated only seldom and slowly about the axis of rotation thereof.

Preferably, the axis of rotation extends essentially in the push-in direction of the subassembly and the rotor is simultaneously pivotable about various, preferably more than two, pivot axes which likewise do not extend parallel to one another, nor does each thereof extend parallel to the axis of rotation. For example, the rotor and the axis of rotation thereof are pivotable about at least two pivot axes, each of which is oriented perpendicularly or obliquely, i.e., inclined, to the axis of rotation. Consequently, the rotor is advantageously pivotable in a vertical pivoting direction so as to compensate for a vertical position offset between the connecting elements, and in a horizontal pivoting direction so as to compensate for a horizontal position offset between the connecting elements.

Preferably, the axis of rotation is intersected by one or each of the pivot axes at one point. One or each of the pivot axes also can neither extend parallel to the axis of rotation nor lie in a common plane therewith and, therefore, be offset, and perpendicular to the axis of rotation or askew to the axis of rotation.

In an embodiment which is advantageous in terms of the arrangement of a first connecting element at the drive-side and freely movable end of the rotor, the mounting is a pivot bearing, wherein the operating-side end of the rotor is mounted. The pendulum bearing allows pivoting movements of the rotor about an infinite number of pivot axes extending perpendicularly to the axis of rotation of the rotor, with the result that, as viewed in the radial direction of the rotor, any possible offset of the connecting elements relative to one another can be compensated for. Preferably, the pendulum bearing is formed as a rolling bearing, wherein the pivoting movements of the rotor into the positions oblique to or else into the position parallel to the push-in direction are made possible by a corresponding shaping of rolling bodies. Such a rolling bearing may, for example, be a self-aligning roller bearing or a self-aligning ball bearing. The self-aligning bearing may, however, also be formed as a sliding bearing, wherein the pivoting or swinging movement of the axis of rotation so as to compensate for the position offset is made possible by at least one convexly curved sliding surface and, if necessary or desirable, additionally a concavely curved sliding surface paired therewith. The pendulum bearing may also be an elastic bearing which has a bearing shell formed of an elastomeric material or an intermediate layer of elastomeric material arranged between two bearing bushings In an embodiment which is advantageous with regard to the lightweight construction of the subassembly, a drive for rotating the rotor is arranged separately from the subassembly on the printing machine, and the subassembly is connectible to this drive via the connecting elements when the subassembly is being pushed into the printing machine. The pressman, when inserting the beam-like subassembly into the printing machine and when removing the subassembly therefrom, only has to lift a subassembly which is comparatively light without the drive, in order to couple the rotor to the drive fixed to the machine, or uncouple the rotor from the drive fixed to the machine. This makes it easier for the pressman, especially because the subassembly is often somewhat bulky and difficult to handle because of the length thereof which corresponds approximately to the format width of the respective printing machine.

In a further embodiment which is advantageous as regards coupling and uncoupling the subassembly without a tool, the rotor and the drive have interposed between them a releasable drive connection which consists of a first connecting element assigned to the subassembly and of a second connecting element assigned to the printing machine. The drive rotates the rotor via the drive connection. When the subassembly is pushed into the printing machine the first connecting element fastened to the subassembly is brought into positive connection with the second connecting element fastened to the printing machine and when the subassembly is drawn but of the printing machine said first connecting element is brought out of positive connection with said second connecting element.

In an embodiment which is advantageous with regard to the design of the mounting as a pendulum bearing with a small pivot angle of the rotor about the pendulum axis, one end of the rotor is mounted in the mounting and the first connecting element is arranged at the other end of the rotor. Very slight pivoting of the axis of rotation of the rotor out of its initial position is therefore sufficient to compensate the position offset of the connecting elements relative to one another and to displace the first connecting element into the correct position relative to the second connecting element.

In an embodiment which is advantageous in terms of the releasable drive connection as an integral part of a wheel mechanism connecting the drive to the rotor, the center axis of the first connecting element corresponds to the axis of rotation of the rotor and the latter is positively connected to the first connecting element fixedly in terms of rotation in the direction of rotation.

In an embodiment which is advantageous with regard to the displacement of the subassembly within the printing machine in the direction perpendicular to the push-in direction of the subassembly, the second connecting element is assigned to an adjusting part, via which the subassembly can be displaced and which is mounted movably in the printing machine stand. For example, the adjusting part is a pivoting lever which is mounted in the printing machine stand and is capable of being coupled to the subassembly and on which the second connecting element is mounted and about the pendulum bearing of which the subassembly is pivotable and which moves and carries the subassembly during pivoting. A displaceable adjusting part may, in other cases, also be an adjusting part which is displaceable perpendicularly to the pushed-in direction.

In an embodiment which is advantageous in terms of dispensing with a special clutch as the releasable drive connection between the drive and the rotor, the releasable drive connection is formed directly by two gear members of a gear connecting the drive to the rotor, the center axes of the two gear members not being arranged coaxially in alignment with one another. The center axes may run at an angle, for example at a right angle to one another if the wheel mechanism is a bevel wheel gear and the two gear members are two bevel wheels. Preferably, the center axes are arranged so as to be offset and parallel to one another. This is the case when the positive and releasable drive connection consists of two spur-toothed gearwheels which are brought into engagement with one another when a subassembly is pushed in and out of engagement when the subassembly is drawn out, in that the gear wheel arranged on the subassembly is displaced axially parallel to the gear wheel arranged via the displaceable adjusting part on the machine stand.

In an embodiment which is advantageous with regard to a preorientation of the subassembly and of the displaceable adjusting part relative to one another prior to the making of the positive connection between the connecting elements, the subassembly and the adjusting part are in each case assigned a centering element, the positions of the centering elements corresponding to one another. It is thereby possible for the connecting elements to be oriented relative to one another in two steps, in a first step, when the subassembly is being pushed in, a correct position of the adjusting part and the subassembly relative to one another being produced by the centering elements coming into positive connection with one another, and, in a second step, when the subassembly is pushed in further, a precision orientation of the first connecting element according to the second connecting element being carried out.

Preferably, the subassembly is a washing device and the rotor is the rotating brush roller of the latter. The already mentioned advantages of the invention and of its developments are also obtained when the subassembly is a machining or indenting module and the rotor is a tool cylinder or numbering cylinder or a driven shaft of the module.

Other features which are considered as characteristic for the invention are set forth in the appended claims.

Although the invention is illustrated and described herein as embodied in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
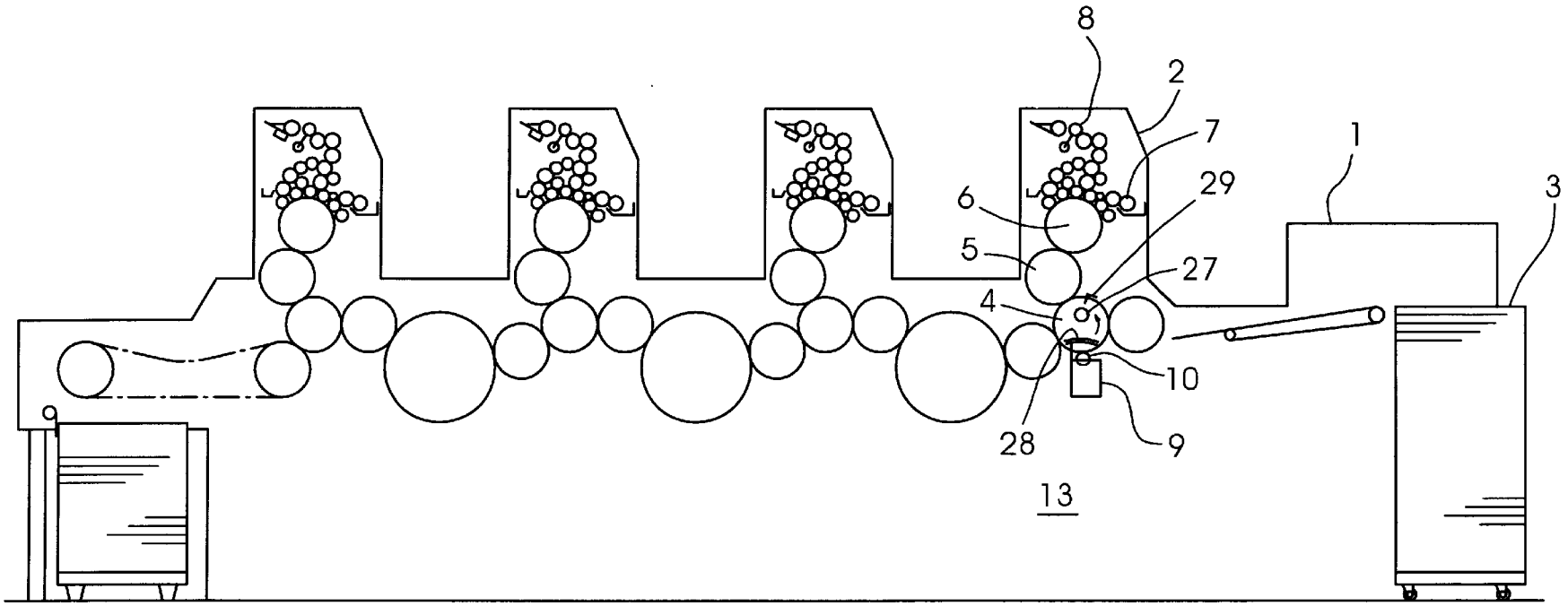
FIG. 1 is a diagrammatic side elevational view of a printing machine with a cleaning device inserted therein in accordance with the invention.

Referring now to the drawings and, first, particularly to FIG. 1 thereof, there is illustrated therein a printing machine 1 with at least one printing unit 2 for printing a sheetlike print carrier 3, a cylinder 4 for transporting the print carrier 3 being disposed in the printing unit 2. The printing machine 1 is a rotary printing machine, the printing unit 2 is an offset printing unit and the cylinder, which cooperates with at least one adjacent ink-carrying cylinder 5, 6, is an impression cylinder. The cylinder 5 is a rubber-blanket cylinder and the cylinder 6 is a printing-form cylinder to which a dampening unit 7 and an inking unit 8 are assigned.

In order to clean the cylinder 4, a subassembly 9 with a rotor 10 extending axially parallel to the cylinder 4 is assigned to the latter. The subassembly 9, illustrated in detail from different perspectives in FIGS. 2 to 5, is a cleaning device, and the rotor 10 is a cleaning roller therefor, formed as a brush, for washing the circumferential surface of the cylinder 5. A linear guide 11 (note FIG. 3) serves for drawing the subassembly 9 out of the printing machine 1 for maintenance purposes, and for pushing or sliding the subassembly 9 into the printing machine 1 after maintenance has been performed. The guide 11 is formed as a rail and, like an electromotive drive 12 (note FIG. 4) for rotating the rotor 10, is fastened fixedly to a stand or frame 13 of the printing machine 1. The separate drive 12 is advantageously an electric motor other than the main electromotive drive of the printing machine 1 which rotates the cylinder 5 during cleaning. The rotational speed ratio between the comparatively high rotational speed of the rotor 10 and the comparatively low rotational speed of the cylinder 5 and, consequently, the scrubbing action of the cleaning roller (rotor 10) can thus be set according to the cleaning requirements by a corresponding activation of the drive 12. The drive 12 rotatively drives the rotor 10 via a transmission formed of gear members 14, 15, 16 and 25, each of which is a gearwheel, and which is referred to hereinafter as a drive connection 17. Through the intermediary of the advantageously formlocking or positive drive connection 17, the drive movement is transmitted to the rotor 10 without avoidable power losses. (In this regard, it is noted that a form-locking connection is one which connects two elements together due to the shape of the elements themselves, as opposed to a force-locking connection, which locks the elements together by force external to the elements.) In a conceivable frictional drive connection, fear of such losses, for example, due to a gear member slipping under high loads, and consequent operating failures, would exist. At an end of the rotor 10, the gear member 16 is fastened to the latter, fixed against rotation relative thereto, by being slipped onto a journal 18 of the rotor 10 and secured by a key. A rotary bearing 19, seated radially outwardly on the journal 18 and in front of the gear member 16, is fastened to the rotor 10 and serves as the rotary mounting for the rotor 10. The gear member 15 is fastened to an adjusting part 20 rotatably by a rotary bearing otherwise not shown in the drawings, so that the gear member 15 meshes with the gear member 14 which further meshes with a gear member 25 (note FIG. 4) driven by the drive 12. The gear members 15 and 16 form connecting elements for releasably connecting the drive connection 17. The gear member 14 is arranged coaxially to a rotary bearing 21 on a shaft 22 of the rotary bearing 21.

Through the intermediary of the rotary bearing 21 disposed axially parallel to the cylinder 4, the adjusting part 20 formed of bearing plates 23 and 24 disposed parallel to one another is arranged on the stand 13 so as to be pivotable relative to the latter about the shaft 22. A pneumatically loadable lifting-piston cylinder with a piston rod 30 serves as an actuating drive 26 for displacing the adjusting part 20 about the shaft 22. The actuating drive 26 is fastened to the stand 13 and is articulatedly connected to the adjusting part 20 via a link 31. Due to the pivoting of the adjusting part 20, the rotor 10 is displaced towards the cylinder 4 into an active position for cleaning the cylinder 4 or away from the cylinder 4 into a passive position, depending upon the pivoting direction.

During each revolution of the cylinder 4, a roller-shaped boss 27, arranged on the cylinder 4 eccentrically to the axis of rotation of the latter, presses against a cam 28 fastened to the adjusting part 20, with the result that the rotor 10 is periodically lifted away from the cylinder 4 out of the active position thereof, so that the rotor 10 does not collide with raised grippers 29 of the rotating cylinder 4. At the same time, the adjusting part 20 is periodically displaced away from the cylinder 4 counter to the restoring action of the actuating drive 26 which, in this case, advantageously acts as a pneumatic spring.

In addition to the aforementioned parts 10, 16 and 19, the subassembly 9 includes a mounting 32 in the form of a pendulum bearing, wherein the rotor 10 is mounted so as to be rotatable about a first axis 35. The mounting 32 is a joint with at least two and preferably three degrees of freedom which correspond to possible rotations of the joint. The first axis 35 is the axis of rotation of the rotor 10. The mounting 32 is arranged at that end of the rotor 10 which is located opposite the gear member 16 and is seated on a journal 33 at the last-mentioned end. At least one second axis 34*a* and 34*b* allows a pivoting of the rotor end to which the gear member 16 is assigned. The axis 34*a* (note FIG. 2) is a vertical axis and the axis 34*b* (note FIG. 3) is a horizontal axis of the mounting 32. The axes 34*a* and 34*b* intersect one another, as well as the first axis 35, at a pole point of the mounting 32. That end of the rotor 10 which has the gear member 16 is pivotable about this pole point in any desired direction about all the axes lying in the plane of the axes 34*a* and 34*b*.

Figure 2:
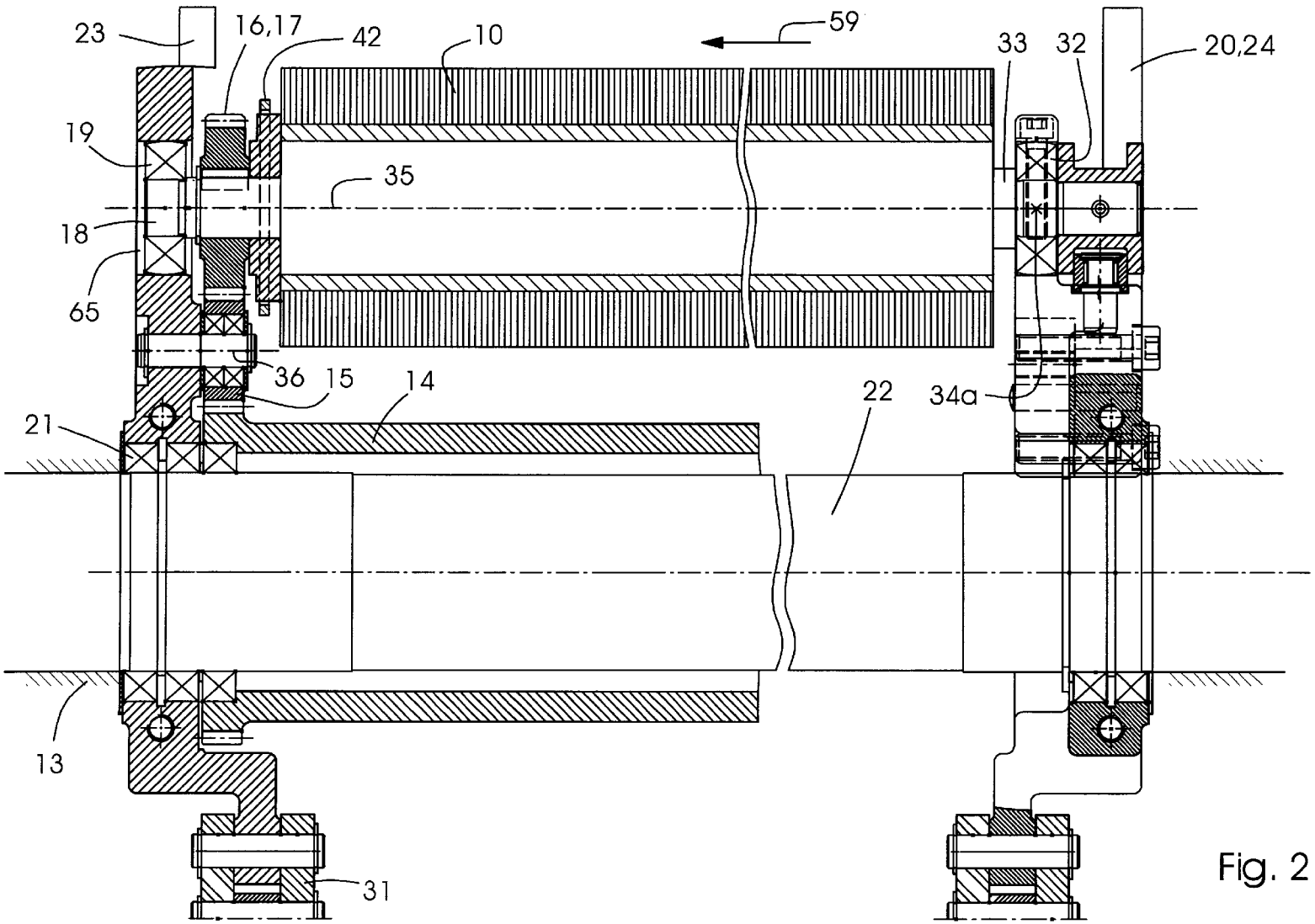
FIG. 2 is a fragmentary, enlarged top plan view, partly in section and broken away, of the cleaning device as inserted in a fragmentary part of the printing machine.
Figure 3:
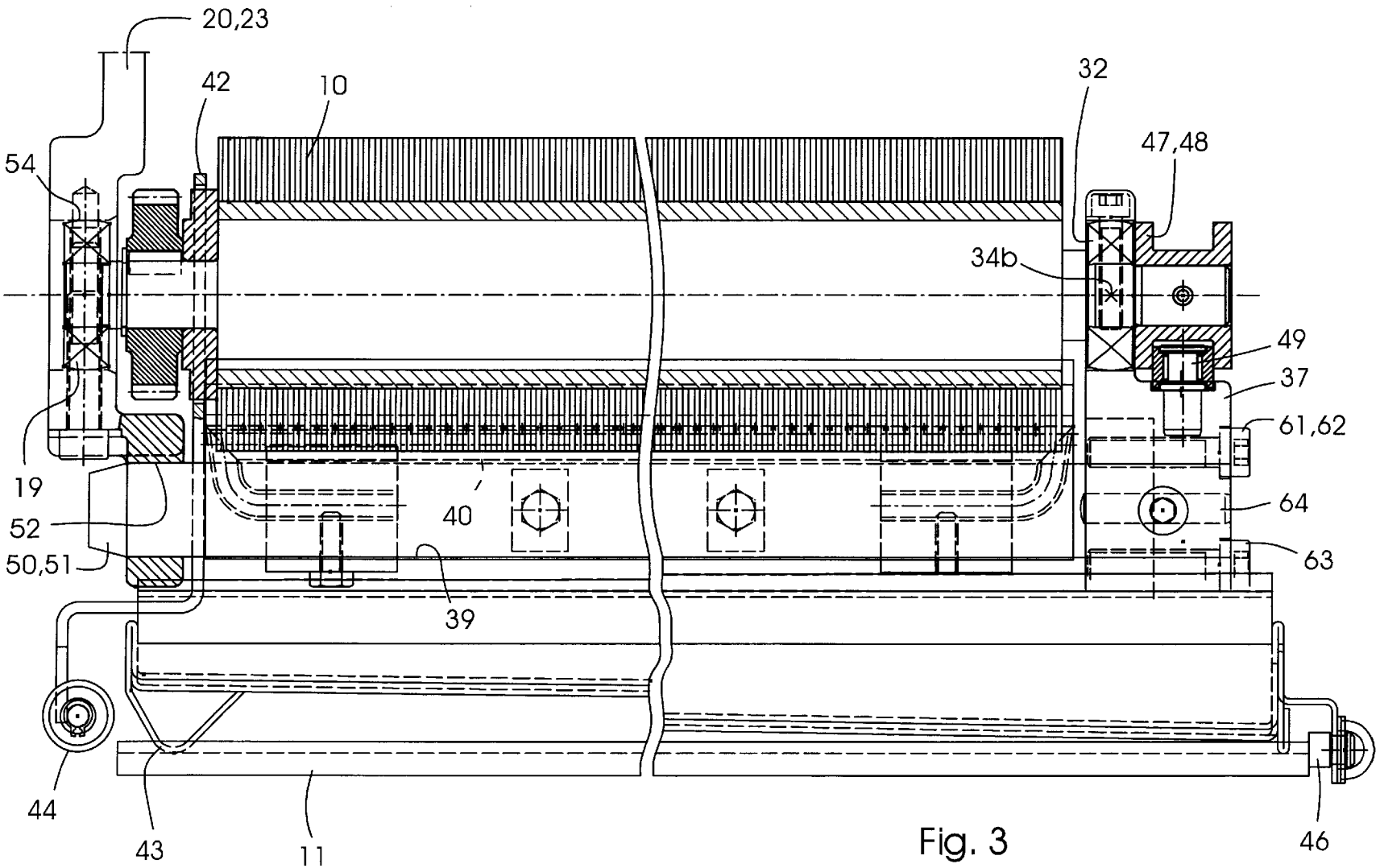
FIG. 3 is a side elevational view of FIG. 2, partly in section and broken away, showing the cleaning device and a trough arranged below the latter.
Figure 4:
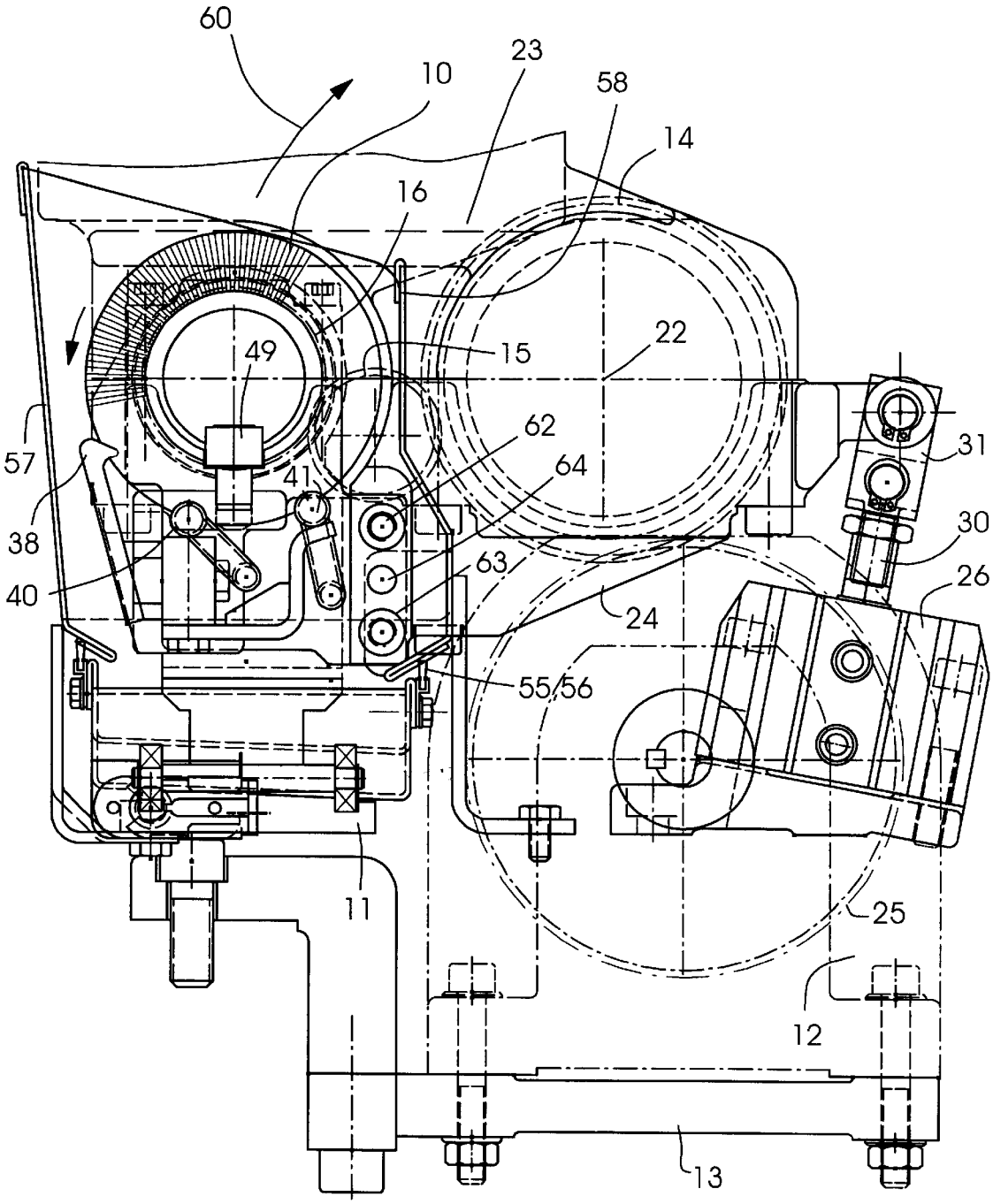
FIG. 4 is a front elevational view of FIG. 4 showing the cleaning device and the trough in greater detail.
Figure 5:
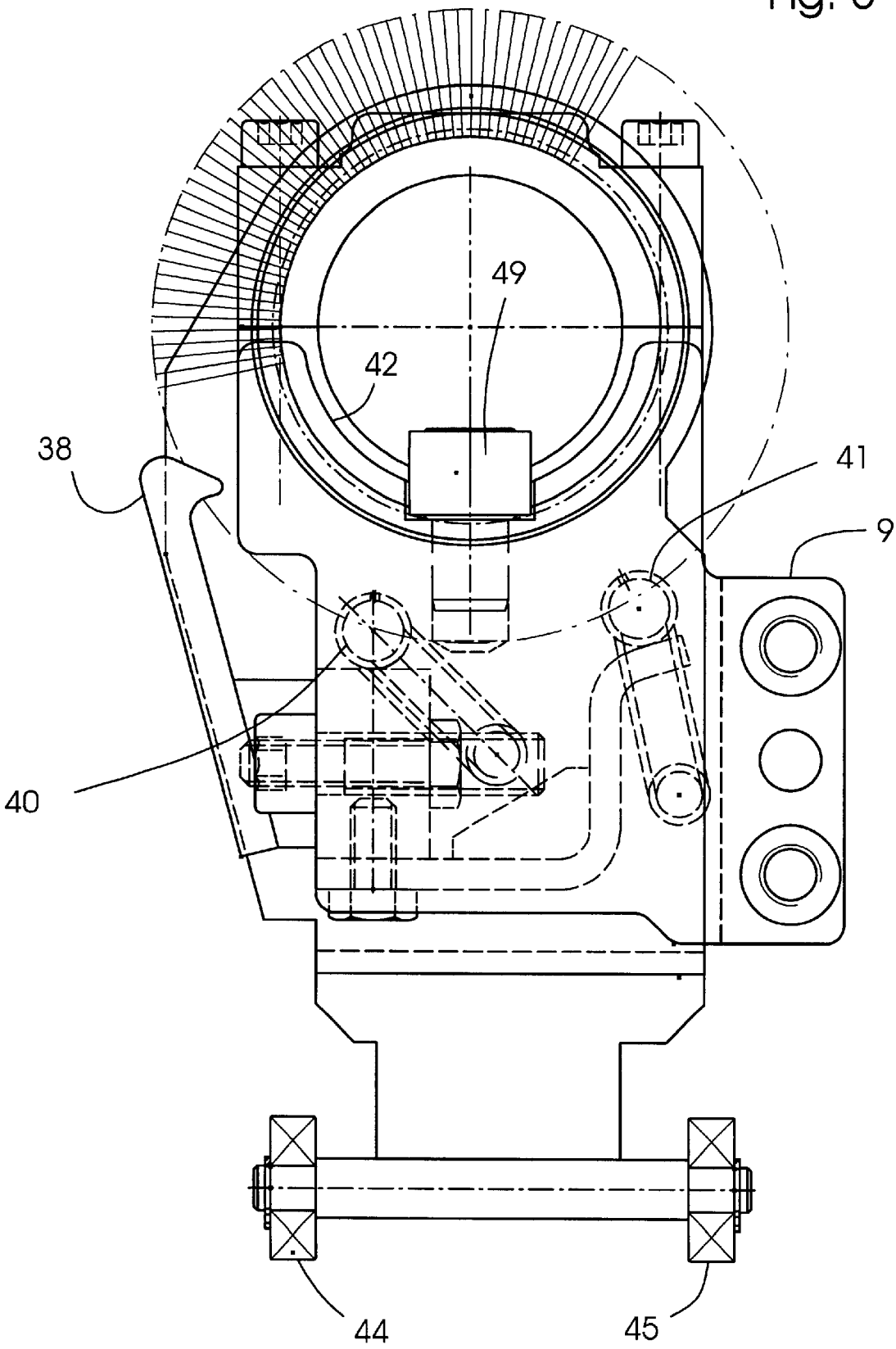
FIG. 5 is an enlarged view of the cleaning device as shown in FIG. 4, in a condition wherein it has been removed from the printing machine.
Figure 6:
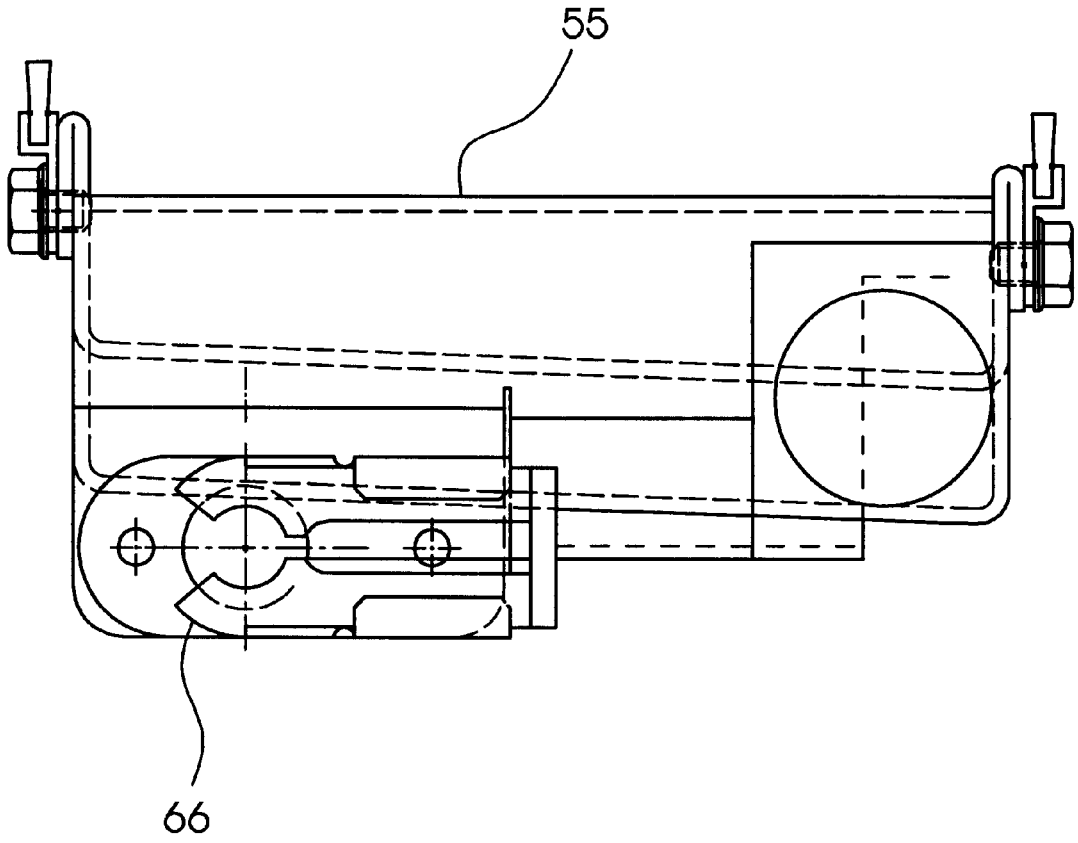
FIG. 6 is an enlarged view of the trough as shown in FIG. 4, in a condition wherein it has been removed from the printing machine.

Due to the pivoting of the rotor 10 about the pole point, the common first axis 35 of the rotor 10 and of the gear member 16 can be pivoted into any desired position oblique to and into the position, shown in FIGS. 2 and 3, parallel to the guide 11 and to an axis of rotation 36 of the gear member 15. The mounting 32 and the rotary bearing 19, respectively, have a convex construction on the outside thereof.

Furthermore, the subassembly 9 includes a carrier 37, a stripper 38, a bar 39 and spray tubes 40 and 41. The mounting 32 is fastened to the carrier 37, and the stripper, which has a hooklike cross section, and the spray tubes 40 and 41, which are provided with nozzles, are fastened to the bar 39. The stripper 38 serves for stripping dirt or soil from the rotor 10, and the spray tubes 40 and 41 serve for spraying a cleaning fluid onto the rotor 10. Both the stripper 38 and the spray tubes 40 and 41 formed as spray-type doctor blades penetrate into the bristles covering the rotating rotor 10. With respect to attaining an economical consumption of the cleaning fluid, it is advantageous for the spray tubes 40 and 41 to spread the covering of bristles open and to inject the cleaning fluid deep into the spread-open covering of bristles.

The subassembly 9 also includes a stay 42 as a support for the end of the rotor 10 located opposite the end at which the mounting 32 is located, the stay 42 annularly surrounding the rotor 10 advantageously with sufficient clearance for oscillating in all directions. The stay 42 is disposed offset to the mounting 32 in the axial direction of the rotor 10. The gear member 16 is located between this stay 42 and the rotary bearing 19.

Furthermore, the subassembly 9, which may be formed as a carriage, has rollers 44 and 45 rotatably mounted on the stay 42, for smooth rolling of the subassembly 9 on the guide 11.

A transmission 47 for producing an oscillation of the rotating rotor 10 in the axial direction thereof likewise belongs to the subassembly 9 and is fastened to the carrier 37. The transmission 47 is a cam gear having a cam body 48 which is fastened to the rotor 10 and rotates together therewith, the cam body 48 being formed with a groove cam extending obliquely to the first axis 35, a cam roller 49 mounted in the carrier 37 and having an axis perpendicular to the first axis 35 running in the groove cam. The cam body 48 is arranged coaxially with the rotor 10. Due to the axial movement of the rotor 10, in addition to the rotation during the cleaning operation, particularly thorough and streak-free cleaning of the cylinder 5 is achieved.

At that end of the subassembly 9 which is opposite the end thereof at which the mounting 32 is located, the subassembly has a centering device 50 which is formed of a pyramidal tapered centering mandrel 51 and of a cut-out centering seat 52, into which the centering mandrel 51 penetrates during centering and thereby centers the subassembly 9 while the latter is being pushed in. The centering mandrel 51 is assigned to the subassembly 9, particularly the carrier 37 of the latter, and the centering bore 52 is assigned to the printing machine 1, particularly the adjusting part 20 of the latter. Deviating therefrom, an interchanged assignment is possible in some cases.

The centering mandrel 51 is formed by one end of the bar 39 which per se has a rectangular profile, the one end being provided all around with four oblique chamfers. The chamfers are flat-faced and extend at a low angle to the longitudinal axis of the centering mandrel 51. Together with the nontapered region of the centering mandrel 51, the rectangularly cut-out centering seat 52 forms a square fit.

Departing therefrom, the centering mandrel 51 may also have a different polygonal profile, and the centering seat 52 may be formed to correspond to the polygonal profile of the centering mandrel 51, so that the centering mandrel 51 and the centering seat 52 together form a polygonal fit, for example, a hexagonal fit. In some cases, for example, in the case of a bar 39 having a circular profile, the centering mandrel 51 may be constructed as a cone and taper, respectively, in that an annular chamfer is lathe-turned onto the end of the bar 39. At least in the region of the length adjoining the annular chamfer, the bar 39 can be tapered all around to a polygonal cross section by overmilling and can be provided with several axially parallel lateral faces which, for example, form the square, the foot of the annular chamfer also being partially removed.

It is advantageous with regard to the aforementioned profilings that the tight form-locking or positive connection between the nontapered region of the centering mandrel 51 and the centering seat 52 affords accurate preorientation of the gear members 15 and 16 relative to one another, and torsion or twisting of the bar 39 by the rotating rotor 10 is ruled out. Depending upon the rotational speed of the rotor 10 and upon the length and elasticity of the bristles bent-over by the stripper 38 and the spray tubes 40 and 41, the rotating rotor 10 acts so as to force the stripper 38 and the spray tubes 40 and 41 away from itself to a greater or lesser extent. This tangential force effect of the rotor 10 is transmitted as a torsional load to the bar 39 via the stripper 38 and the spray tubes 40 and 41. The bar 39 is fastened at one end thereof to the carrier 37 and, due to the form-locking or positive plug connection of the other end thereof, is thus held fixed against relative rotation at both ends with the result that the bar 39 can, without appreciable deformations, absorb the loads exerted thereon by the rotor 10. In addition to the centering device 50, the convex outer contour of the rotary bearing 19 forms a further centering device 54 in the construction shown.

The printing machine 1 includes a further subassembly 55 which is capable of being pushed into the printing machine 1, the subassembly 55 being a trough formed with an inclined or oblique bottom, for collecting dirty cleaning fluid stripped off from the rotor 10. The subassembly 55 is formed as a slide and is provided, at a front end thereof in the push-in or slide-in direction, with a sliding block and a runner, respectively, for sliding on the guide 11 which has a U-shaped profile. At the other end thereof, the subassembly 55 is provided with a stop 46 which limits the push-in movement and which abuts the guide 11 and, deviating from the embodiment shown in FIG. 3, may also abut the stand or machine frame 13, when the subassembly 55 has reached the end position thereof.

By arranging the guide 11 on the stand 13 separate from the adjusting part 20, not only is very high stability afforded, but also, the following further advantages ensue: the subassembly 55 is held in an absolutely stationary manner by the guide 11 when the subassembly 9 is in operation. Overflow and spillage, respectively, of the fluid stored in the subassembly 55, which is formed as a fluid reservoir, due to the operation of the subassembly 9 in association with the periodic movement of the adjusting part 20 is virtually ruled out. A risk of such spillage would exist if the guide 11 carrying the subassembly 55 were arranged on the adjusting part 20.

The subassembly 55 is sealed-off at the upper edge of the subassembly 55, by an elastic seal 56 formed of at least one brush strip, with respect to substantially vertical housing walls 57 and 58 serving as splash protection. The housing walls 57 and 58 fastened to the stand or machine frame 13, not to the adjusting part 20, have angled-away portions, against the underside of which, the seal 56 rests and, over the top side of which, the fluid can flow off into the subassembly 55.

The printing machine 1 is equipped with the guide 11 for inserting the subassembly 9 into the printing machine 1 in a first direction represented by the arrow 59 (note FIG. 2), and the subassembly 9 can be displaced in a second direction represented by the arrow 60 (note FIG. 4) by the movement of the adjusting part 20. The guide 11 is a guide rail firmly screwed to the basic stand or frame of the printing machine 1. The first direction 59 is perpendicular to the print carrier transport direction and the second direction corresponds substantially to the radial direction of the cylinder 4. The subassembly 55 can be pushed into the printing machine 1 and drawn out of the latter, independently of the subassembly 9, in a direction parallel to the first direction 59. The subassembly 55 is simultaneously guided by the guide 11.

The demounting and mounting of the subassemblies 9 and 55 are described hereinbelow. Initially, the subassembly 9 is introduced, with the rotary bearing 19 located in front, into the printing machine 1 through an aperture or a similar cutout in the side wall of the printing machine 1. The subassembly 9 is then pushed on the guide 11 in a direction towards the drive side of the printing machine 1, the subassembly 9 being held obliquely by the pressman in a manner comparable to holding a wheelbarrow. In other words, the wheelbarrow principle adopted is based upon the pressman lifting that end of the subassembly 9 to which the mounting 32 is assigned, so that the subassembly 9 rests and rolls on the guide 11 only via the rollers 44 and 45 arranged at the other end of the subassembly 9.

When the subassembly 9 is pushed farther in the direction of the drive side of the printing machine 1, the centering mandrel 51 initially enters into the centering seat 52 thereof, with the result that the connecting elements or gear members 15 and 16 are preoriented relative to one another during the coupling of the subassembly 9. The wheelbarrow posture of the subassembly 9 is necessarily converted into a horizontal position of the bar 39 and of the subassembly 9 by the further penetration of the centering mandrel 51 into the centering seat 52 with an exact fit. The centering devices 50 and 54 are arranged stepwise, so that, when the subassembly 9 is being pushed in, shortly after the centering mandrel 51 has penetrated into the centering seat 52, the rotary bearing penetrates into a centering seat 64 in the adjusting part 20.

The centering seat 65 is provided with an annular chamfer facilitating the entry of the rotary bearing 19, and is introduced as a bore into the adjusting part 20. As a result of the penetration of the rotary bearing 19 into the centering seat 65 belonging to the centering device 54, a precision alignment of the connecting elements and gear members 15 and 16, respectively, with one another is attained, with the result that these can be pushed carefully into engagement with one another. As mentioned hereinbefore, the gear or transmission members 15 and 16 are constructed as gear wheels and can have chamfered teeth which make careful mutual engagement even easier, as illustrated.

The rollers 44 and 45 are located approximately at the same height or level as the rotary bearing 19, as viewed in the longitudinal direction of the subassembly 9, and the length of the guide 11 is dimensioned so that the rollers 44 and 45 run beyond the end of the guide 11 during the centering of the centering device 50, i.e., during the penetration of the centering mandrel 51 into the centering seat 52. When the rollers 44 and 45 have left the guide 11, the guide 11 does not oppose any movement of the subassembly 9 towards the cylinder 5 and away from the latter again by the adjusting part 20.

After the connecting elements or gear members 15 and 16 are in engagement with one another and, therefore, the drive connection 17 is closed, the subassembly 9 is fixed relative to the adjusting part 20 on the operating side of the printing machine 1 by a fixing device 61. The fixing device 61 is formed of a pin 64 for in-register pinning the bearing plate 24 to the carrier 37 and of at least one screw 62 and 63 for screwing the bearing plate to the carrier. The subassembly 55 is subsequently pushed parallel to the subassembly 9 into the printing machine 1 on the guide 11. This is likewise performed in a manner comparable to the pushing of a wheelbarrow, the subassembly 55 sliding on the guide 11 by the sliding block 43 formed on the subassembly 55 and being raised somewhat at the other end thereof when being pushed in. After the subassembly 55 has reached the end position thereof below the subassembly 9, the subassembly 55 is fixed in the position thereof by a locking device 66, and the subassembly 9 is connected to supply lines, and the subassembly 55 to a disposal line, after which the subassemblies 9 and 55 are ready for operation.

Demounting takes place in the opposite manner, the supply lines being separated, and, for this purpose, quick-action couplings being shut off on both sides. The subassembly 55 is unlocked and drawn out laterally. The fixing device 61 is then opened and the subassembly 9 is drawn out of the printing machine 1.

I claim:

1. A printing machine with a subassembly couplable therewith and being insertable therein, the subassembly comprising: a rotor mounting for a rotor-which allows, in addition to a rotation of said rotor about a first axis, a pivoting of said rotor with two degrees of freedom including vertical and horizontal degrees of freedom relative to the first axis.

2. The printing machine according to claim 1, wherein said two degrees of freedom are orthogonal to said first axis.

3. The printing machine according to claim 1, wherein said mounting is a pendulum bearing.

4. The printing machine according to claim 1, including a drive external to the subassembly, for rotating the rotor, the subassembly, when being pushed into the printing machine, being couplable with said drive.

5. The printing machine according to claim 4, wherein said rotor is drivable by said drive via a releasable drive connection including a first connecting element fastened to the subassembly, and a second connecting element external to the subassembly.

6. The printing machine according to claim 5, wherein said mounting and said first connecting element are disposed at opposite ends of the subassembly.

7. The printing machine according according to claim 5, wherein said first connecting element is arranged coaxially with said rotor and is connected so as to be fixed against rotation relative to said rotor.

8. The printing machine according to claim 5, wherein said second connecting element is fastened to an adjusting part of the printing machine, said adjusting part being movably connected to a stand of the printing machine.

9. The printing machine according to claim 8, wherein the subassembly includes at least one centering device for orienting said adjusting part and the subassembly during insertion of the subassembly into the printing machine.

10. The printing machine according to claim 5, wherein said connecting elements are two gear members of said drive connection for rotating said rotor, said gear members being axially offset with respect to one another.

11. The printing machine according to claim 1, wherein the subassembly is a cleaning device, and said rotor is a cleaning roller of said cleaning device.

12. The printing machine according to claim 1, wherein said at least one second axis is oriented perpendicularly to said first axis.

13. The printing machine according to claim 1, wherein said mounting is a pendulum bearing.

14. A printing machine comprising:

a subassembly including a rotor mounted in a mounting which allows, in addition to a rotation of said the rotor about a first axis, a pivoting of said rotor about at least one second axis which is oriented at an angle to said first axis;

a drive external to said subassembly, for rotating the rotor, via a releasable drive connection including a first connecting element fastened to said subassembly, and a second connecting element external to said subassembly, said subassembly, when being pushed into the printing machine, being couplable with said drive; and said mounting and said first connecting element of said drive connection are disposed at opposite ends of said subassembly.

15. The printing machine according to claim 14, wherein said at least one second axis is oriented at an oblique angle or inclination to said first axis.

16. The printing machine according according to claim 14, wherein said first connecting element is arranged coaxially with said rotor and is connected so as to be fixed against rotation relative to said rotor.

17. The printing machine according to claim 14, further comprising a second connecting element external to said subassembly, said second connecting element is fastened to an adjusting part of the printing machine, said adjusting part being movably connected to a stand of the printing machine.

18. The printing machine according to claim 17, wherein said subassembly includes at least one centering device for orienting said adjusting part and said subassembly during insertion of said subassembly into the printing machine.

19. The printing machine according to claim 14, wherein said connecting elements are two gear members of said drive connection for rotating said rotor, said gear members being axially offset with respect to one another.

20. The printing machine according to claim 14, wherein said subassembly is a cleaning device, and said rotor is a cleaning roller of said cleaning device.

* * * * *

UNITED STATES PATENT AND TRADEMARK OFFICE

CERTIFICATE OF CORRECTION

PATENT NO. : 6,484,636 B1
DATED : November 26, 2002
INVENTOR(S) : Karl-Heinz Seefried It is certified that error appears in the above-identified patent and that said Letters Patent is hereby corrected as shown below:

Column 11,
Line 19, should read as follows -- comprising: a rotor mounting for a rotor which allows, in --

Signed and Sealed this

Twenty-fourth Day of June, 2003

JAMES E. ROGAN
*Director of the United States Patent and Trademark Office*